United States Patent [19]

Uchiyama et al.

[11] 4,431,343

[45] Feb. 14, 1984

[54] LEG CLAMPING DEVICE FOR JACK UP PLATFORM

[75] Inventors: Tomoyoshi Uchiyama, Osaka; Youichi Hattori, Suita; Kouki Koyanagi, Asukamura; Toshio Ohkoshi, Izumi; Takaaki Ishihama, Nara; Kouji Toda, Iyo Mishima, all of Japan

[73] Assignee: Hitachi Shipbuilding & Engineering Limited, Osaka, Japan

[21] Appl. No.: 454,148

[22] Filed: Dec. 29, 1982

Related U.S. Application Data

[63] Continuation of Ser. No. 184,250, Sep. 5, 1980, abandoned.

[51] Int. Cl.[3] ..... E02B 17/06

[52] U.S. Cl. ..... 405/198; 254/95

[58] Field of Search ..... 405/195, 196, 197, 198, 405/199, 200; 24/263 A; 254/95, 104, 105

[56] References Cited

U.S. PATENT DOCUMENTS

| | | | |
|---|---|---|---|
| 2,968,853 | 1/1961 | McKeown | 24/263 A |
| 3,343,371 | 9/1967 | Heitkamp | 405/198 |
| 4,255,069 | 3/1981 | Yielding | 405/196 |
| 4,269,543 | 5/1981 | Goldman et al. | 405/198 |

*Primary Examiner*—David H. Corbin

*Attorney, Agent, or Firm*—Barnes, Kisselle, Raisch, Choate, Whittemore & Hulbert

[57] ABSTRACT

A leg clamping device for a jack up platform having legs extending through the platform and a rack attached to each of the legs therealong and meshing with a drive pinion mounted on the platform. The leg clamping device comprises a plurality of clamp pieces engageable in the furrows of the rack, a bearing body fixedly mounted on the platform and supporting the clamp pieces individually movably toward or away from the rack, and locking means each provided for each of the clamp pieces individually for releasably locking the clamp piece in engagement with the rack furrow.

10 Claims, 16 Drawing Figures

LEG CLAMPING DEVICE FOR JACK UP PLATFORM

This application is a continuation of Ser. No. 184,250, 9/5/80, abandoned.

This invention relates to a leg clamping device for a jack up platform having legs for vertically movably supporting the platform by which device the leg can be fastened to the platform, and more particularly to a device for use in a jack up platform of the rack-and-pinion type provided with a raising or lowering rack on each of its legs for clamping together the rack and the platform at the desired raised or lowered position.

With jack up platforms of the rack-and-pinion type, a pinion mounted on the platform and meshing with a rack on each of its legs is driven to move the leg longitudinally thereof relative to the platform. The leg is provided with a guide for guiding and supporting the leg and is allowed to play relative to the guide, while the pinion is also allowed to play relative to the rack, whereby the parts are made smoothly movable. A considerable amount of such play is needed for the platform since it is usually a huge structure. Consequently a backlash occurs between the leg and the platform, giving rise to the problem that the weight of the platform and the bending moment acting on the leg can not be satisfactorily supported by the leg as its axial load. To overcome this problem, a mating rack having a short length and a plurality of teeth is usually mounted on the platform with its teeth opposed to those of the rack on the leg so as to come into or out of mesh with the rack on the leg. Thus the leg is clamped by the meshing engagement of the mating rack with the rack on the leg. However, if the pitch of the teeth on one of the racks involves an error in this case, one or two pairs of opposed teeth only may be properly in mesh but the other teeth will be held out of intimate meshing engagement, with the result that the meshing teeth alone support the whole load and are therefore subject to deformation or damage due to the excessive load. Moreover, since the pitch error involved in the rack on the leg varies from portion to portion, it is impossible to make the rack on the leg in conformity with the pitch error in the mating rack. Accordingly it is impossible to solve the foregoing problem with clamping devices of the construction described.

The main object of this invention is to provide a clamping device comprising members mounted on the platform and properly engageable with a required number of teeth on a rack attached to the leg even when the pitch of the rack teeth involves an error to completely eliminate the backlash between the leg and the platform so that the weight of the platform and the bending moment on the leg can be satisfactorily supported by the leg as its axial load.

To fulfill this object, the present invention provides a clamping device for a jack up platform having legs and a rack attached to each of the legs, comprising a plurality of clamp pieces engageable in the furrows of the rack individually, a bearing body fixedly mounted on the platform and supporting the clamp pieces individually movably toward or away from the rack, and locking means each provided for each of the clamp pieces individually for releasably locking the clamp piece in engagement with the rack furrow.

Since the clamp pieces of the device are individually movable toward or away from the rack for engagement therewith, the error in the pitch of rack teeth can be compensated for by suitably positioning the individual clamp pieces relative to the rack, so that all the clamp pieces are properly engageable with the rack to achieve the desired result.

A preferred example of the locking means is a wedge member provided between one end of the clamp piece remote from the rack and the bearing body. Another preferred example comprises a threaded rod extending from the above-mentioned end of the clamp piece and a screw boss rotatably supported by the bearing body and screwed on the threaded rod.

According to a preferred embodiment of the invention, the bearing body is supported vertically movably by a guide member fixed to the platform and is provided with means for locking the bearing body in the desired position, whereby the position of the clamp pieces relative to the phase of the rack is finely adjustable, such that irrespective of the phase of the rack after the leg has been raised or lowered relative to the platform, the clamp pieces are properly engageable with the rack.

Suitable examples of the bearing body locking means are wedge members provided between the fixed member on the platform and the opposed ends of the bearing body in the direction of its movement, or jacks, such as screw jacks and hydraulic or pneumatic jacks having a locking function, similarly disposed.

Further preferably, the bearing body is formed with openings for inspecting the state of engagement of the clamp pieces with the rack. By the inspection through the openings, the bearing body is properly positionable for the adjustment of phase, and the clamp pieces can be checked for proper engagement.

Various other features and advantages of the invention will be easily understood from the following description of the preferred embodiments with reference to the accompanying drawings, in which:

FIG. 3 is a side elevation partly in section and showing a fixed frame having a bearing body disposed therein;

FIG. 4 is a front view showing the frame of FIG. 3;

FIG. 5 is a plan view partly in cross section and showing the frame of FIG. 3;

FIG. 6 is a side elevation partly in section and showing the bearing body with clamp pieces provided therein;

FIG. 7 is a plan view partly in section of FIG. 6;

FIG. 8 is a front view of FIG. 6;

FIG. 9 is a rear view of FIG. 6;

FIG. 10 is a plan view showing a wedge member engageable with the upper or lower end of the bearing body;

FIG. 11 is a front view of FIG. 10;

FIG. 12 is a plan view of the clamp piece;

FIG. 13 is a side elevation partly in section and showing a bearing body with clamp pieces placed therein;

FIG. 14 is a plan view partly in section and showing the bearing body and guide members therefor;

FIG. 15 is a front view of FIG. 13; and

FIG. 16 is a side elevation showing the clamping device as installed in place.

Figure 1:
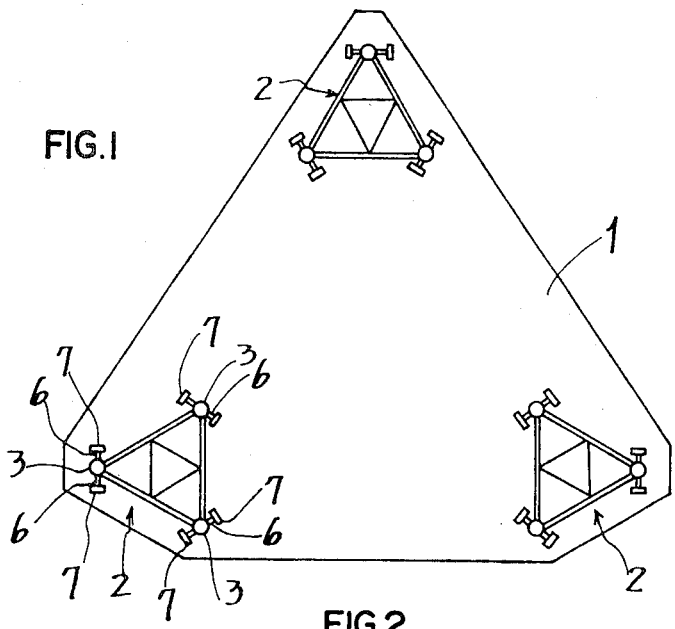
FIG. 1 is a plan view showing an exemplary jack up platform.
Figure 2:
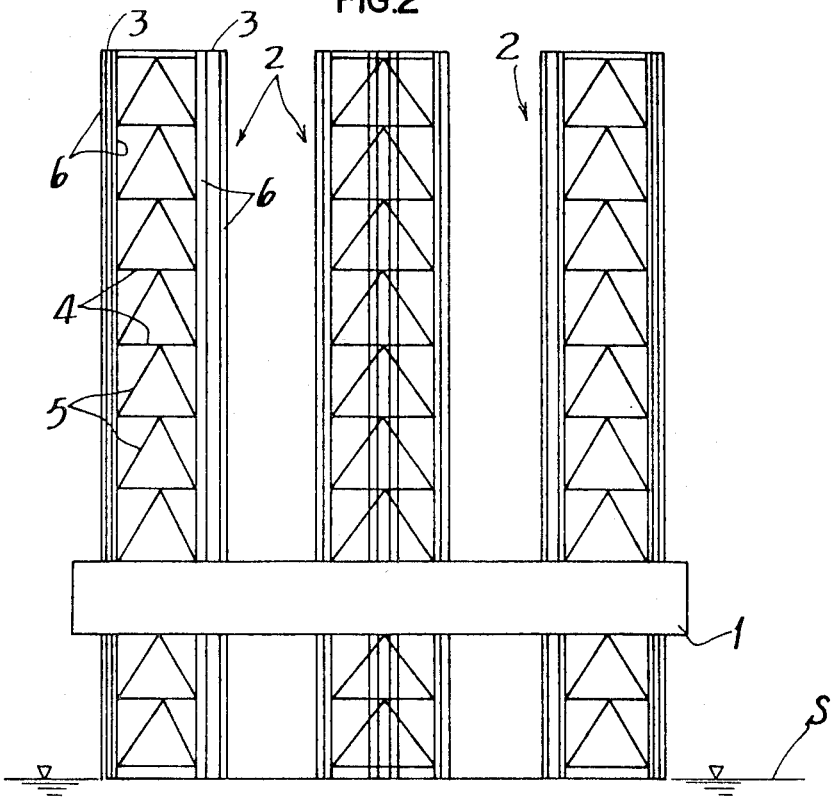
FIG. 2 is a front view of the same.

A drilling rig, an example of jack up platform, will be briefly described first with reference to FIGS. 1 and 2. A platform 1 is provided with a plurality of legs 2 extending therethrough movably longitudinally of the legs. The legs 2 are lowered to place their lower ends on the sea bottom, and the platform 1 is supported by the legs above the sea level S to be free of the influence of waves. The desired operation is performed from the platform 1 in this position. The leg 2 for supporting the platform 1 comprises, for example, groups of three parallel posts 3 connected together and reinforced as positioned one group above another with use of beams 4 and diagonal braces 5. Each of the posts 3 is provided on its opposite outer surfaces with a pair of racks 6 extending longitudinally of the post. A pinion 7 meshing with each rack 6 for raising or lowering the leg 2 is mounted on the platform 1. The platform 1 has guide members (not shown) for vertically movably guiding the legs 2. The platform 1 is supported on the legs 2 by the meshing engagement of the racks 6 with the pinions 7 and drivingly movable longitudinally of the legs 2 relative thereto. To eliminate the backlash between the platform 1 and the legs 2, the platform 1 is provided with clamping devices engageable with the racks 6 for clamping the rack 6 and the platform 1 together.

Figure 3:
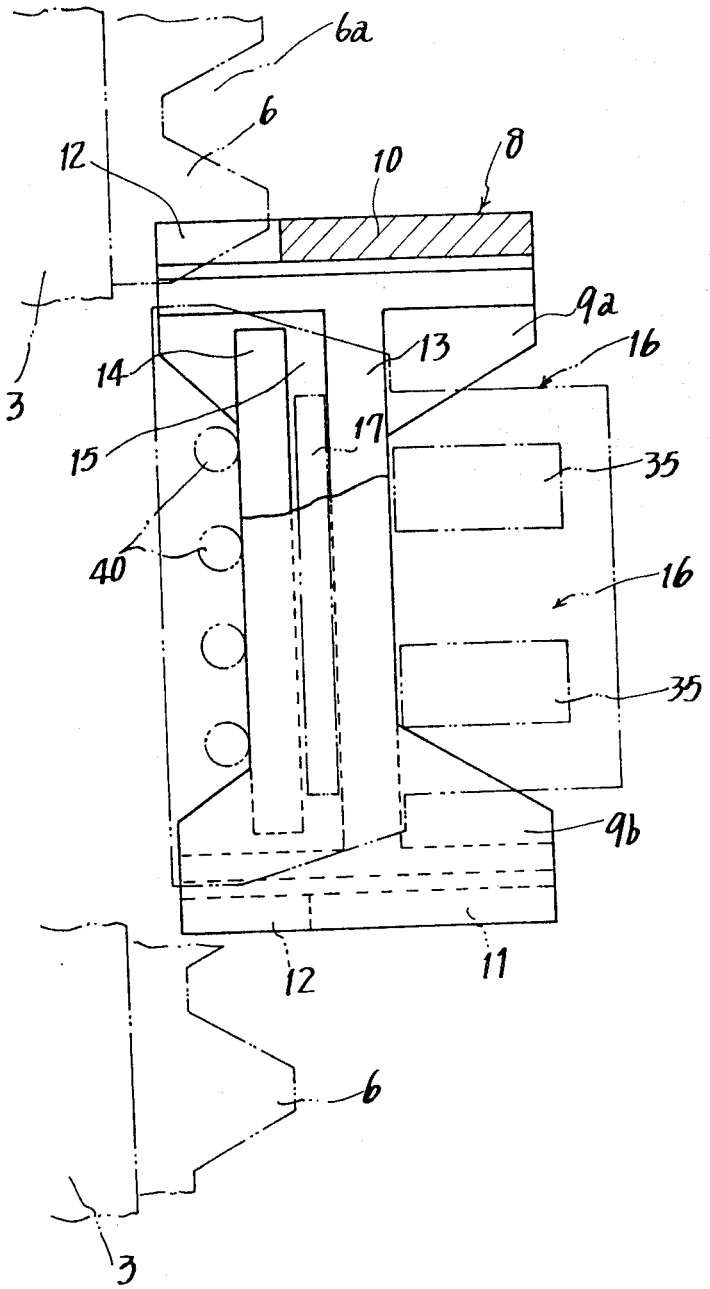
FIGS. 3 to 12 show a first embodiment of the clamping device of this invention.
Figure 4:
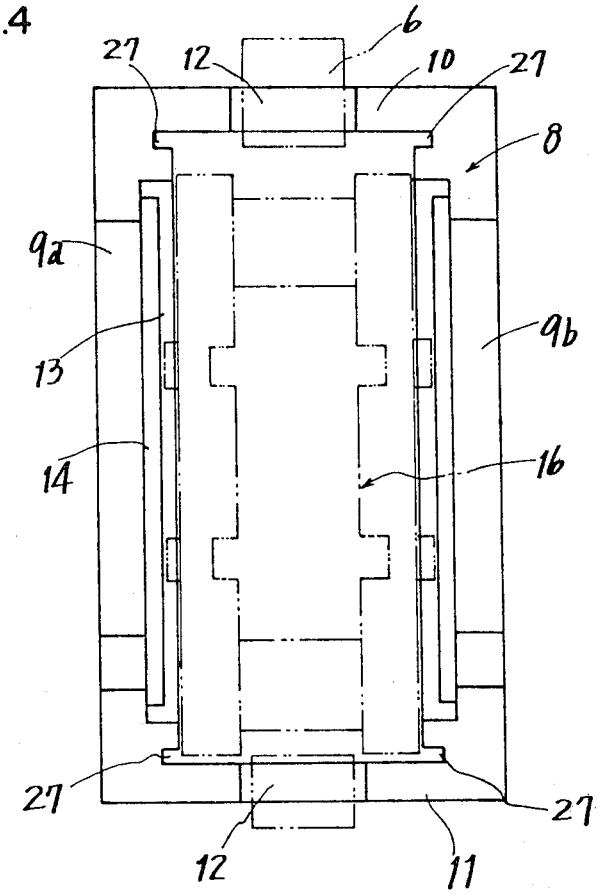
Figure 5:
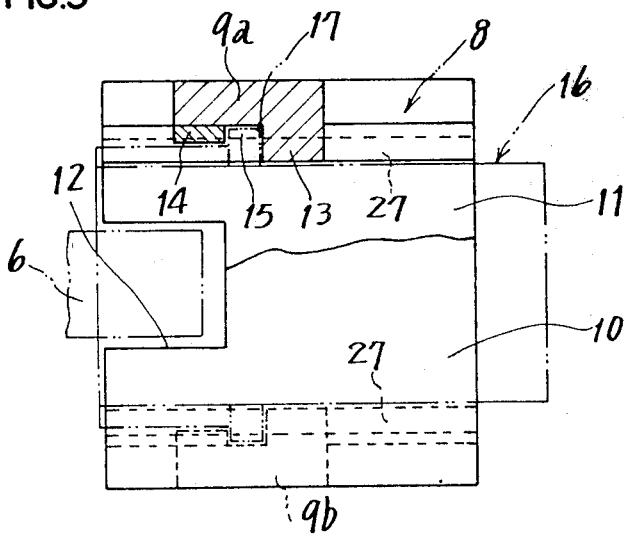

With reference to FIGS. 3 to 12 showing a first embodiment of the clamping device of this invention, a fixed frame 8 opposed to the rack 6 on the leg 2 is mounted on the platform 1 and has in its interior clamp pieces engageable with the rack 6. As shown in FIGS. 3 to 5, the frame 8 comprises a pair of approximately I-shaped side walls 9*a*, 9*b*, an upper wall 10 and a lower wall 11 and resembles a rectangular ring when seen from the front, namely from the rack side. Each of the upper and lower walls 10, 11 is formed, in the middle of its one end close to the rack 6, with a cutout 12 for passing the rack 6 therethrough. Each of the side walls 9*a*, 9*b* is provided, on its inner side, with a vertical projection 13 and a strip 14 in parallel to the projection and fastened to the wall with bolts to form a slide groove 15 between the projection 13 and the strip 14.

Figure 6:
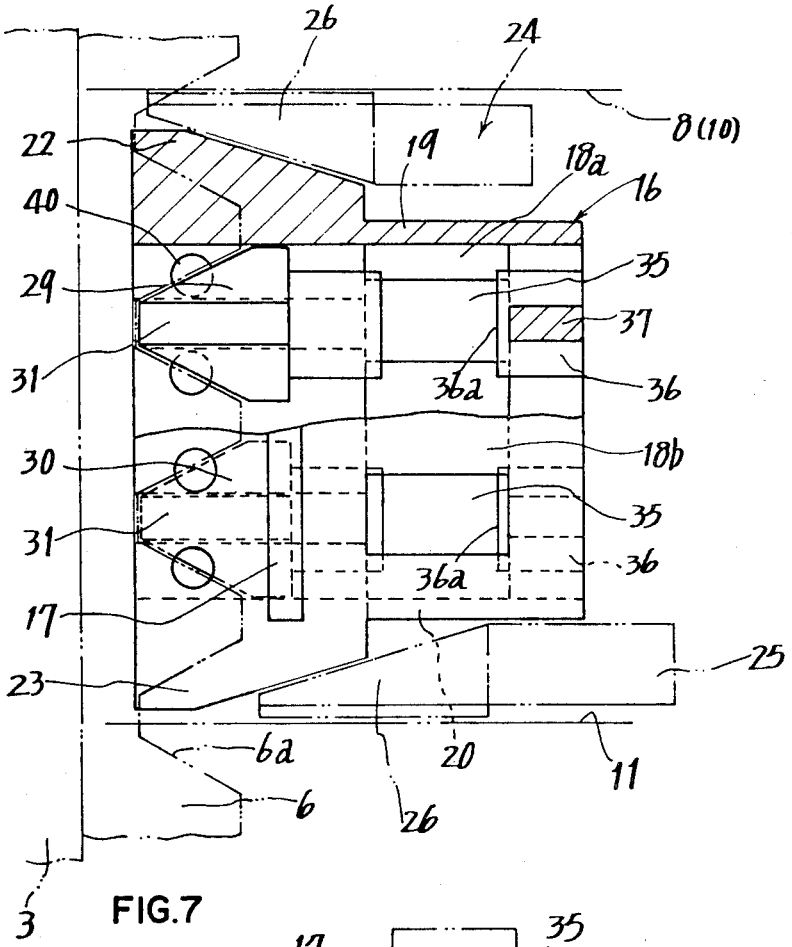
Figure 10:
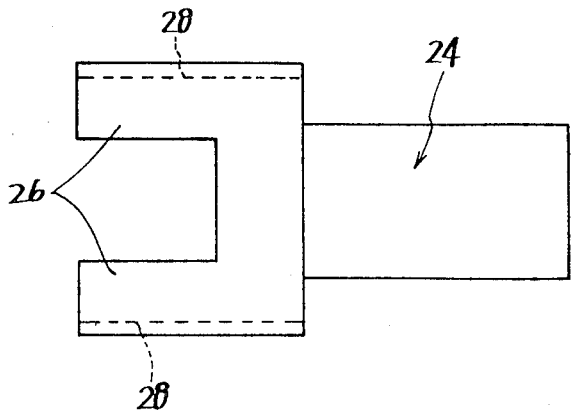
Figure 11:
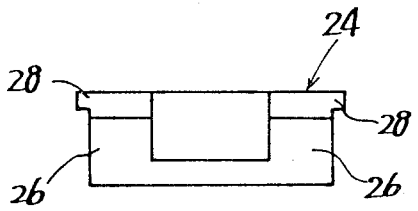

As seen in FIGS. 6 to 9, the bearing body 16 fitting in the fixed frame 8 has engaging projections 17 fitting in the slide grooves 15 and is slidable along the grooves 15. The bearing body 16 comprises a pair of side walls 18*a*, 18*b*, an upper wall 19 and a bottom wall 20, and like the frame 8, is in the form of a rectangular ring when seen from the front. Each of the upper wall 19 and the bottom wall 20 is formed, in the middle of its one end toward the rack 6, namely front (the same as hereinafter) end, with a cutout 21 for passing the rack 6 therethrough. The upper wall 19 has on each side of its front half portion a tapered projection 22 extending downward away from the rack 6, namely toward the rear (the same as hereinafter) end thereof. Similarly the bottom wall 20 has on each side of its front half portion a tapered projection 23 extending upward toward the rear end thereof. Raising and lowering wedge members 24 and 25 are arranged between the upper wall 20 of the bearing body 16 and the upper wall 10 of the frame 8 and between the bottom wall 20 of the bearing member 16 and the lower wall 11 of the frame 8, respectively. As shown in FIGS. 6, 10 and 11, each of these wedge members 24, 25 has a pair of tapered heads 26 for bearing contact with the tapered surfaces of the pair of tapered projections 22 or 23. Each of the upper and lower wedge members 24, 25 is formed on its opposite side edges with engaging projections 28 fittable in slide grooves 27 formed in the inner surfaces of the slide walls 9*a*, 9*b* of the frame 8 and extending from the front rearward and is slidable along the grooves 27.

Figure 7:
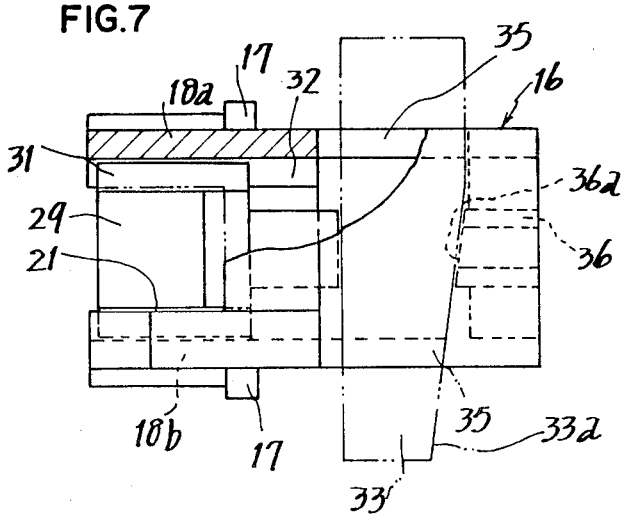
Figure 8:
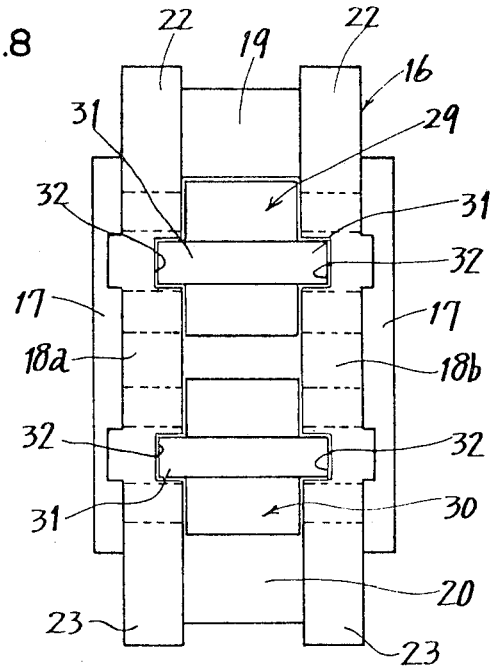
Figure 9:
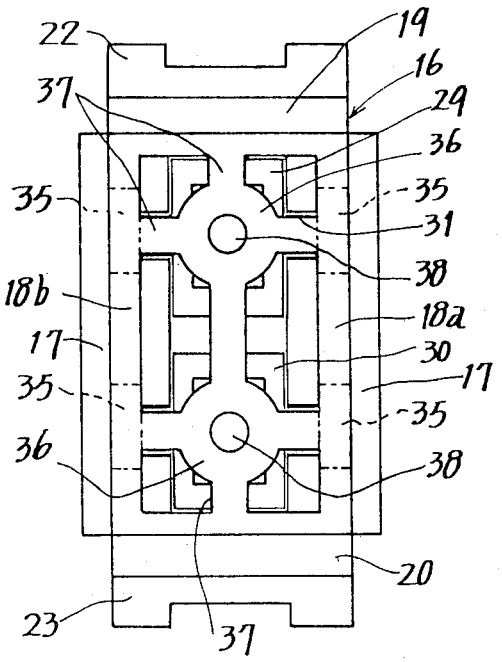
Figure 12:
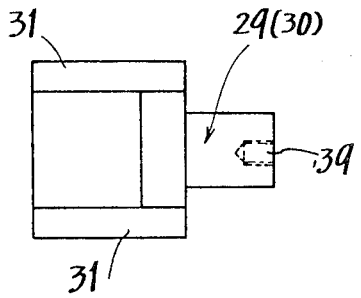
Figure 13:
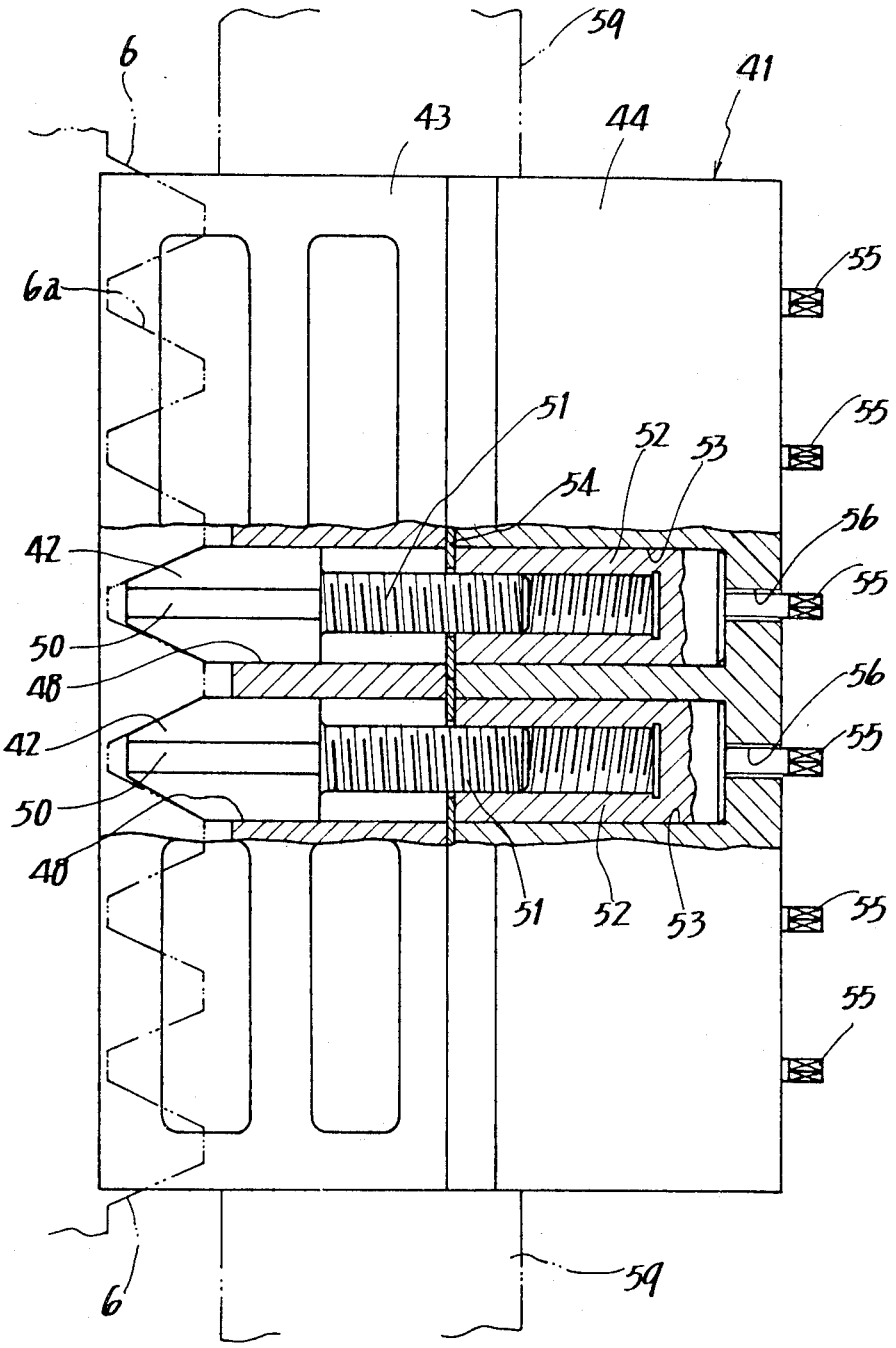
FIGS. 13 to 16 show a second embodiment.
Figure 14:
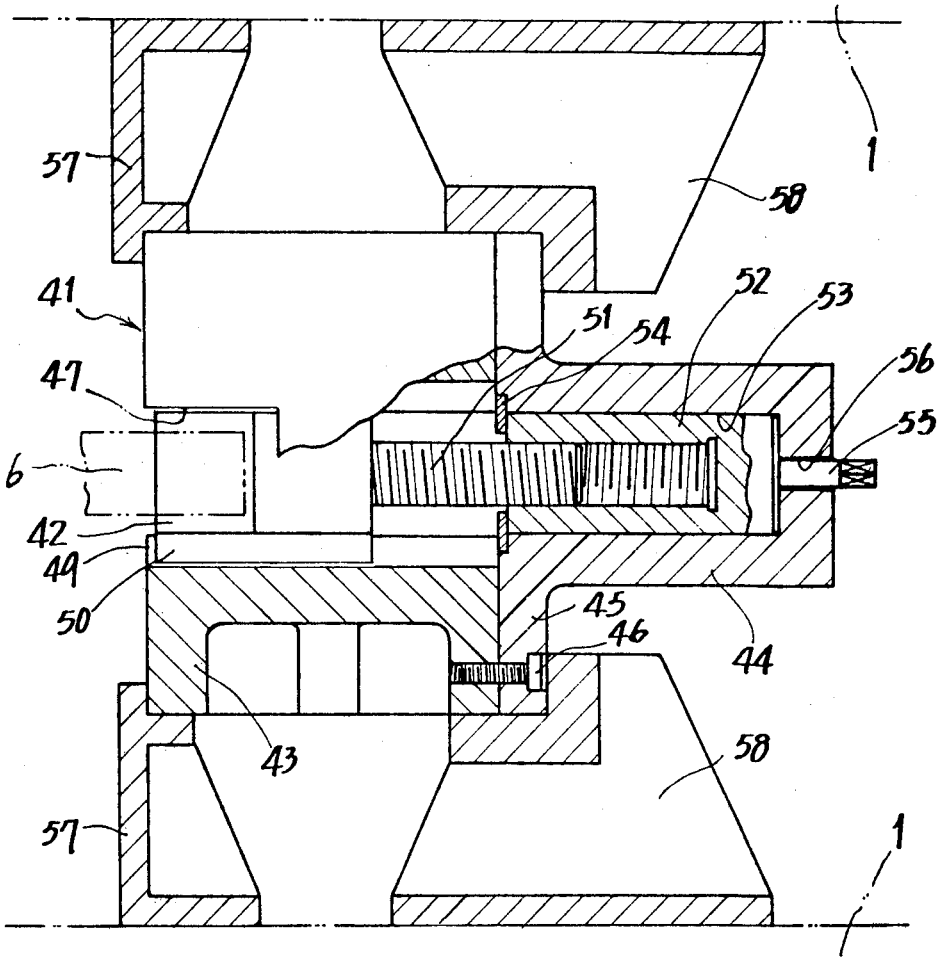
Figure 15:
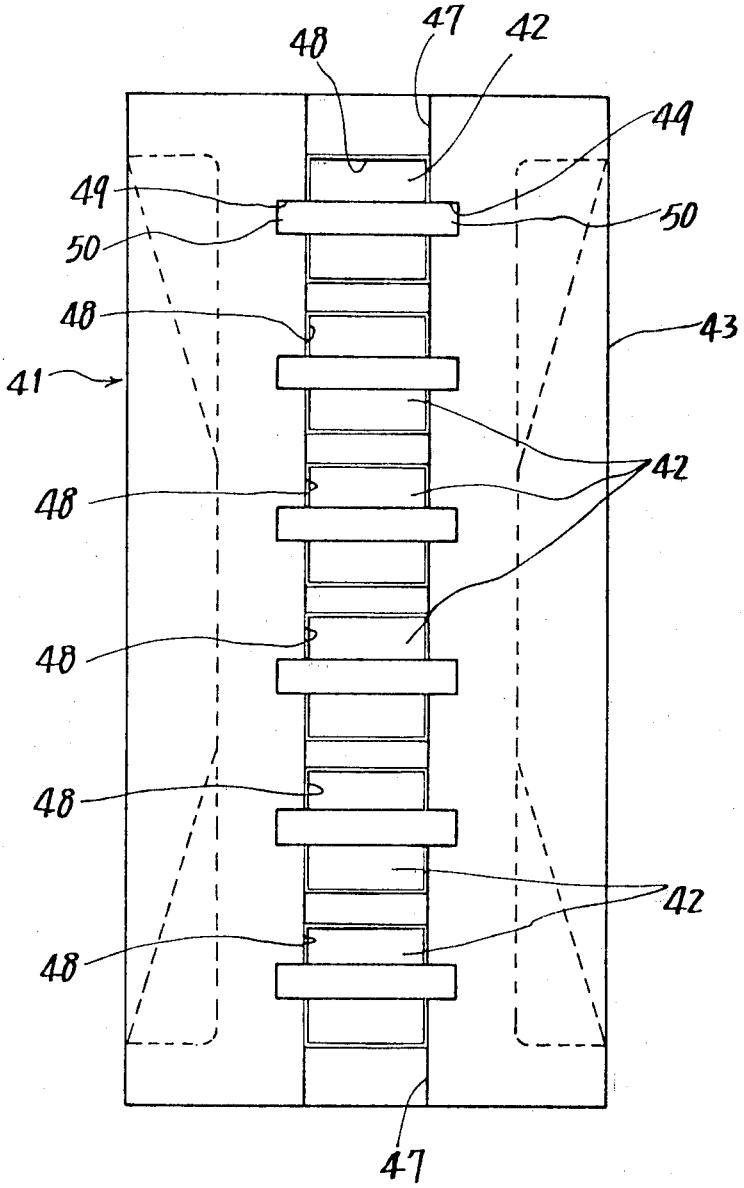

Two clamp pieces 29 and 30 are disposed within the bearing body 16 as positioned one above the other. These clamp pieces 29 and 30 have a tapered head fittable in a furrow 6*a* of the rack 6 and are provided on opposite sides thereof with protrusions 31 slidably fitting in slide grooves 32 formed in the inner surfaces of the side walls 18*a* and 18*b* of the bearing body 16 and extending from the body front end rearward as shown in FIGS. 6, 7 and 12. In the rear half of each of the side walls 18*a* and 18*b* of the bearing body 16, there are formed apertures 35 for passing therethrough wedge members 33 which are adapted to bear against the rear ends of the clamp pieces 29 and 30. The wedge member 33 has a tapered rear face 33*a*. A wedge guide portion 36 having a tapered face 36*a* for bearing contact with the tapered face 33*a* is supported by radial arms 37 at the rear end of the bearing body 16. The wedge guide portion 36 has a bore 38 for passing therethrough a handle rod for advancing or retracting the clamp piece 29 (30). The clamp piece is formed in its rear end with a threaded bore 39 in which the forward end of the handle rod is removably screwed. The side walls 18*a* and 18*b* of the bearing body 16 have openings 40 for inspecting the engagement of the clamp pieces 29 and 30 with the rack 6.

The clamping device will be used in the following manner. The leg 2 is moved upward or downward with the clamp pieces 29 and 30 retracted to a rear portion of the bearing body 16. After the platform 1 has been adjusted to the desired level by moving each leg 2 upward or downward, the clamp pieces 29 and 30 are brought into engagement with the rack 6 in the manner to be described below. The bearing body 16, which is vertically movable along the frame 8, is adjustable to the proper position by varying the amounts of insertion of the raising and lowering wedge members 24 and 25, whereby the clamp pieces 29 and 30 can be brought into conformity with the phase of furrows 6*a* in the rack 6. The bearing body 16 in position can be fastened to the frame 8 by driving the wedge members 24 and 25 in place. Subsequently the handle rod is screwed into the threaded bore 39 in each of the clamp pieces 29 and 30, and the clamp piece is forced into engagement with the rack furrow portion 6*a* opposed thereto. The handle rod is then removed. The wedge members 33 are forced into the apertures 35 of the bearing body 16 to lock the clamp pieces 29 and 30. Since the clamp pieces 29 and 30 are movable forward or backward individually, they can be properly engaged with the rack despite the error in the tooth pitch of the rack 6. The phase of the rack 6 and the engagement of the clamp pieces 29 and 30 with the rack 6 can be inspected from outside through the openings 40.

In this way, the rack namely the leg, can be clamped in place. Since the clamp pieces 29 and 30 intimately fit in furrows 6*a* of the rack 6 and are fastened thereto by the wedge members 33, the load acting between the platform and the leg can be supported satisfactorily. More specifically, the weight of the platform 1 and the bending moment acting on the leg 2 can be satisfactorily supported by the leg as an axial load thereon. Both axially upward and downward components of force can also be supported.

A second embodiment of the invention will be described with reference to FIGS. 13 to 16. Throughout the drawings, like parts are referred to by like reference numerals. This embodiment includes a bearing body 41 comprising a holder 43 and a screw boss housing 44 detachably attached at opposite side flanges 45 to the rear side of the holder 43 by bolts 46. Six clamp pieces 42 arranged in parallel along the rack 6 are slidingly guided by the holder 43 toward or away from the rack 6. The holder 43 comprises an integral block and is formed in the center of its front side with a vertical cutout groove 47 for passing the rack 6 therethrough. Six bores 48 of rectangular cross section for inserting the clamp pieces 42 extend through the holder 43 from its front side to rear side and are arranged side by side longitudinally of the rack 6 with the same pitch as the teeth on the rack 6. The opposite side surfaces defining the bore 48 are formed with slide grooves 49 having slidingly fitted therein protrusions 50 on both sides of the clamp piece 42. The clamp piece 42 is formed at its front end with a tapered head engageable in the furrow 6*a* of the rack 6 and has a threaded rod 51 extending from its rear end. The threaded rods 51 of the clamp pieces 42 are screwed in screw bosses 52 which are rotatably retained in the housing 44. The screw bosses 52, which are hollow cylindrical, are fitted in bottomed cylindrical bores 53 formed in the housing 44. A retaining member 54 clamped between the holder 43 and the housing 44 has an inner peripheral portion in engagement with the front end of the screw boss 52. A turning handle rod 55 extending from the rear end of the screw boss 52 projects rearward from the housing 44 through a hole 56 formed in the bottom wall of the bore 53 in the housing 44.

The bearing body 41 of the construction described above is vertically movably supported by front guide brackets 57 in engagement with the front end corners of the holder 43 and by rear guide brackets 58 in engagement with the flanges 45 of the housing 44 and with opposite sides of the rear end of the holder 43. These brackets are fixed to the platform 1. The position of the bearing body 41 is vertically adjustably determined by jacks 59 fixed to the platform 1 and bearing on the upper and lower ends of the body. The jacks 59 must have a locking function, so that screw jacks or hydraulic jacks having locking means are useful.

Figure 16:
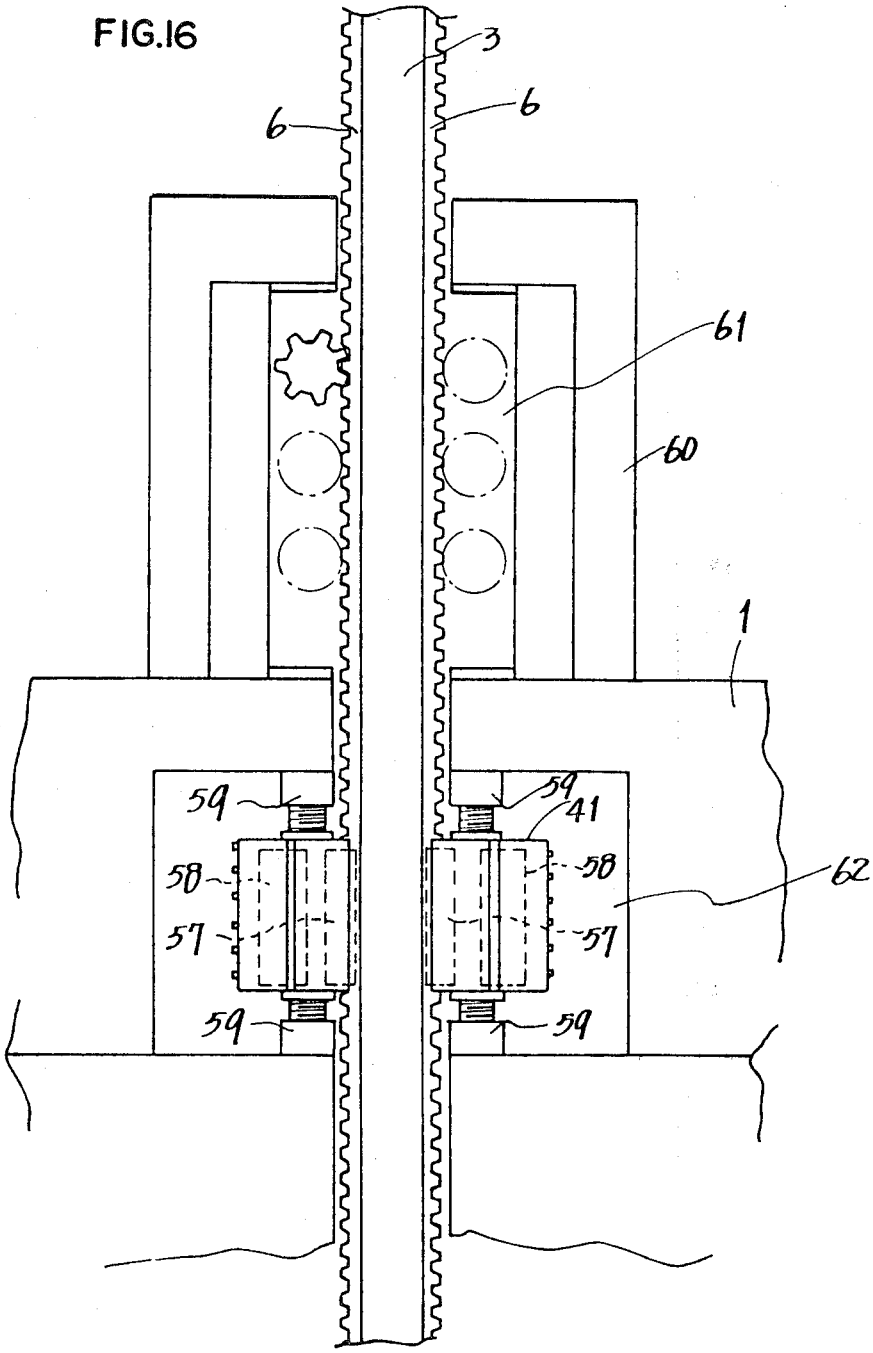

FIG. 16 shows clamping devices of the second type as installed in the platform 1. A jack house 60 on the platform 1 has accommodated therein a jack up assembly 61 of the rack-and-pinion type meshing with racks 6 on a leg 2 to drivingly move the leg. Disposed in the interior of the platform 1 below the jack house 60 is a chamber 62 for accommodating the clamping devices. Each bearing body 41 is vertically movably supported by guide brackets 57 and 58 fixed to side walls of the chamber 62 and is held in place by jacks 59 fixed to the upper and bottom walls of the chamber 62.

The clamp pieces 42 of the second embodiment are moved toward or away from the rack 6 by turning the handle rods 55. The clamp piece 42 is locked in engagement with the rack 6 by the self-locking engagement of the threaded rod 51 with the screw boss 52. Thus the single means moves the clamp piece 42 and acts to withstand the horizontal reaction acting on the clamp piece 42. The construction in which the bearing body 41 comprises two dividable segments, namely the holder 43 and the housing 44 bolted thereto, faciliates inspection and replacement of the clamp pieces 42 and screw bosses 52. Since the bearing body 41 is vertically movably supported by the guide brackets 57 and 58, the horizontal reaction and moment of rotation acting on the bearing body 41 are delivered via these brackets to the platform 1, which withstands such load. The upward or downward reaction acting on the bearing body 41 is delivered to the platform 1 through the jack 59. Furthermore since the bearing body 41 is held in place vertically adjustably by the jacks 59 to properly position the clamp pieces 42 for the rack 6, the leg can be clamped in an optimum condition. For example, the position of the bearing body 41 is so adjustable that when the platform is to be supported after jacking up, the lower faces of the heads of the clamp pieces will bear on the upper faces of rack teeth, or when the leg is to be supported for towing, the upper faces of the clamp heads will bear against the lower faces of rack teeth. The load acting on the leg 2 is detectable to provide an indication when a load sensor is attached to the jack portion.

With the two embodiments described, it is desirable that the heads of the clamp pieces 29, 30 and 42 have the same shape as the rack tooth, with their extremities cut off to provide shortened tapered head portions, such that when the clamp piece is forced against the rack with its upper and lower tapered faces brought into contact with rack teeth, the tapered end of the clamp piece will be held out of contact with the bottom of the furrow in the rack. Furthermore suitable electrical, hydraulic or pneumatic drive means can be used for forcing the raising and lowering wedge members 24, 25, the clamp pieces 29, 30 and the wedge members 33 of the first embodiment into place, or for rotating the turning handle rods 55 of the second embodiment. In this case, the clamp pieces can be brought into engagement with rack teeth with a uniform contact pressure.

The clamping device of this invention is useful for oil rigs and other jack up platforms.

What is claimed is:

1. A leg clamping device for a jack up platform having legs extending through the platform and at least one rack attached to each of the legs therealong and meshing with a drive pinion mounted on the platform, comprising:

a bearing body mounted on the platform for each rack, a plurality of engaging teeth supported in the bearing body adapted to separately move linearly toward and away from the rack and having tapered heads to engage in and disengage from corresponding furrows of the rack, and locking means provided for each tooth individually for releasably locking the tooth with its head in engagement with a corresponding rack furrow, the independent movability and the taper of the heads of said teeth enabling the heads of all said teeth to engage properly in said furrows despite possible pitch errors in said furrows.

2. A device as defined in claim 1 wherein each of the locking means comprises a wedge member provided between one end of the tooth remote from the rack and the portion of the bearing body opposed to said one end.

3. A device as defined in claim 1 wherein each of the locking means comprises a threaded rod extending from one end of the tooth remote from the rack and a screw boss rotatably supported by the bearing body and having the threaded rod screwed therein.

4. A device as defined in claim 1 wherein the bearing body is supported movably longitudinally of the rack and independently of the platform by a guide member fixed to the platform and is provided with means for locking the bearing body in a desired position.

5. A device as defined in claim 4 wherein the guide member comprises a frame having the bearing body disposed in its interior.

6. A device as defined in claim 5 wherein the means for locking the bearing body comprises a wedge member provided between each of opposite ends of the bearing body in the direction of movement thereof and the inner surface of the frame facing the end of the bearing body.

7. A device as defined in claim 4 wherein the means for locking the bearing body comprises a jack mounted on the platform for bearing contact with each of opposite ends of the bearing body in the direction of movement thereof.

8. A device as defined in claim 7 wherein the jack is a screw jack.

9. A device as defined in claim 7 wherein the jack is a hydraulic jack having a locking function.

10. A device as defined in claim 1 wherein the bearing body is provided with openings for inspecting the engagement of the tapered heads of the teeth with the furrows of the rack.

* * * * *